US008448465B2

(12) United States Patent
Modi

(10) Patent No.: US 8,448,465 B2
(45) Date of Patent: May 28, 2013

(54) MULTIFACETED GEMSTONES WITH CONNECTING LINK

(75) Inventor: Nirav Modi, New York, NY (US)

(73) Assignee: Firestar Diamond, Inc., New York, NY (US)

( * ) Notice: Subject to any disclaimer, the term of this patent is extended or adjusted under 35 U.S.C. 154(b) by 232 days.

(21) Appl. No.: 12/872,001

(22) Filed: Aug. 31, 2010

(65) Prior Publication Data

US 2012/0047949 A1 Mar. 1, 2012

(51) Int. Cl.
*A44C 17/02* (2006.01)

(52) U.S. Cl.
CPC ..... *A44C 17/02* (2013.01)
USPC ..... 63/28; D11/90; D11/93; 63/4; 63/26; 63/38

(58) Field of Classification Search
CPC ..... A44C 17/02
USPC ..... 63/4, 26, 28, 33, 38, 3, 32; D11/6, D11/89, 90, 91, 93, 3–5, 13–18, 92, 86; 59/12, 59/84, 93
See application file for complete search history.

(56) References Cited

U.S. PATENT DOCUMENTS

| | | | | | |
|---|---|---|---|---|---|
| 2,270,270 | A | * | 1/1942 | Clare | 63/32 |
| 2,596,965 | A | * | 5/1952 | Troy | 2/239 |
| 3,820,201 | A | * | 6/1974 | Burckhardt | 63/38 |
| 4,604,876 | A | * | 8/1986 | Hoffmann | 63/32 |
| 4,708,001 | A | * | 11/1987 | Alburger | 63/32 |
| 4,809,417 | A | * | 3/1989 | Normann, Jr. | 29/896.41 |
| D306,836 | S | * | 3/1990 | Bulgari | D11/93 |
| 6,006,547 | A | * | 12/1999 | Bergagnini | 63/26 |
| 6,145,341 | A | * | 11/2000 | Leong | 63/1.11 |
| D649,904 | S | * | 12/2011 | Froehlich | D11/89 |
| D656,059 | S | * | 3/2012 | Froehlich | D11/89 |
| 2005/0172668 | A1 | * | 8/2005 | Bayer et al. | 63/28 |
| 2005/0274144 | A1 | * | 12/2005 | Goughnour et al. | 63/32 |
| 2008/0087042 | A1 | * | 4/2008 | Heimann | 63/26 |
| 2011/0203317 | A1 | * | 8/2011 | Miller | 63/15 |

FOREIGN PATENT DOCUMENTS

JP 06327509 A * 11/1994

* cited by examiner

*Primary Examiner* — Jack W. Lavinder
*Assistant Examiner* — Emily Morgan
(74) *Attorney, Agent, or Firm* — Gottlieb, Rackman & Reisman, P.C.

(57) ABSTRACT

A gemstone and link assembly for forming a piece of jewelry. The gemstone is cut to provide enhanced brilliance and radiance. The gemstone is securely maintained within the link. The link is fabricated of reduced metal thus providing an aesthetically pleasing assembly.

12 Claims, 13 Drawing Sheets

MULTIFACETED GEMSTONES WITH CONNECTING LINK

FIELD OF THE INVENTION

This invention relates generally to items of jewelry and more particularly to multifaceted gemstones and links securing the gemstones for assembly into pieces of jewelry.

BACKGROUND OF THE INVENTION

Present day jewelry items, such as bracelets, necklaces, earrings and pendants, in the form of chains of precious metal (e.g., gold, silver or platinum) are well known. Such chains are formed of links of such metal. In order to enhance the aesthetic appeal of these jewelry items, designers have substituted gemstones for one or more of the links. These gemstones are set in conventional metal settings where the metal is substantially visible, especially when viewed from the side or back of the jewelry item. This detracts from the jewelry item as a whole as the item is unable to provide a complete gemstone look. Still further, the standard gemstones used in such items often lack radiance or brilliance thus further detracting from the aesthetic appeal of the jewelry piece.

Thus, there is a need to provide a multifaceted gemstone and link therefor for use in an item of jewelry which overcome the disadvantages of previously known jewelry items.

SUMMARY OF THE INVENTION

Accordingly, one aspect of the present invention is to provide a new multifaceted gemstone and link therefor for an item of jewelry which overcome the disadvantages of prior gemstones linked in jewelry items.

Another aspect of the present invention is to provide a new multifaceted gemstone and link therefor for an item of jewelry which can decrease the amount of metal required for the link.

Yet a further aspect of the present invention to provide a new multifaceted gemstone and link therefor for an item of jewelry which securely attaches the gemstone to the link.

A still further aspect of the present invention is to provide a new multifaceted gemstone and link therefor for an item of jewelry in that the gemstone, when mounted in the link, provides a complete look that emphasizes the gemstone and minimizes the metal of the link even when the combination is viewed from the rear and sides.

Another aspect of the present invention to provide a new multifaceted gemstone and link therefor for an item of jewelry which enables the jewelry item to have radiance and brilliance.

These and other aspects of the invention are achieved by providing a gemstone having a front and a back, the gemstone comprising a lower pavilion and an upper crown. The crown has a top surface and a pair of longitudinally opposed multifaceted sides that slope downwardly away from the top and towards the pavilion. The top surface of the crown has two laterally opposed top surface portions that are separated one from the other by a single horizontally directed linear straight peak that runs in a longitudinal direction between said sides. Each top surface portion slopes downwardly towards the front and back of the gemstone respectively. The pavilion has a bottom surface defined by at least one longitudinally opposed horizontally directed planar bottom portion.

First and second gemstones according to the present invention are used to form a jewelry element or assembly including at least one link. The link has a spacer for separating the gemstones one from the other in an opposed spaced relationship. The link further has a leaf member having first and second angularly directed leaf arms which form a v-configuration. The first leaf arm abuts at least a portion of the multifaceted side of the first gemstone and the second leaf arm abuts at least a portion of the multifaceted side of the second gemstone.

These and other aspects of the invention, together with features and advantages thereof, will become apparent from the following detailed description of several preferred embodiments, when taken in conjunction with the accompanying drawings.

DETAILED DESCRIPTION OF THE INVENTION

Figure 1B:
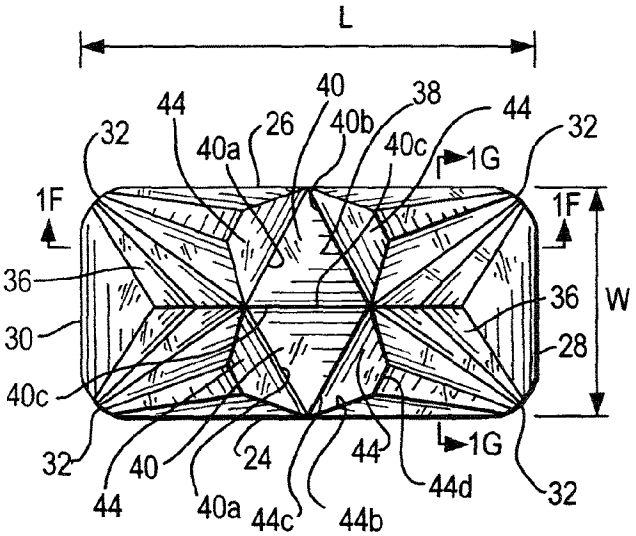
FIG. 1B is a top plan view thereof.
Figure 1A:
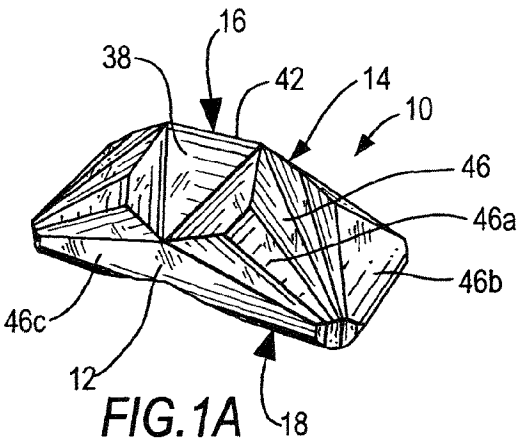
FIG. 1A is perspective view of a gemstone according to one embodiment of the present invention.
Figure 1C:
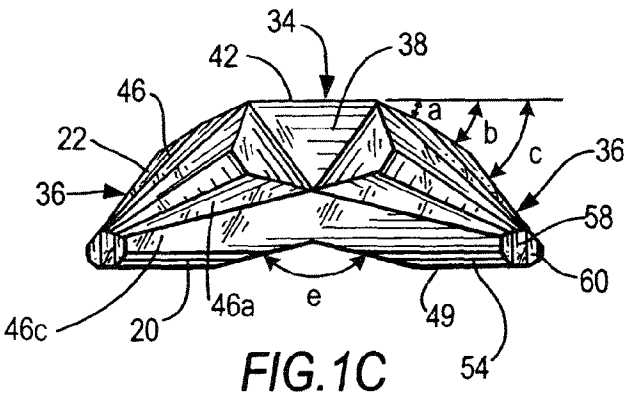
FIG. 1C is a front elevation view thereof.
Figure 1E:
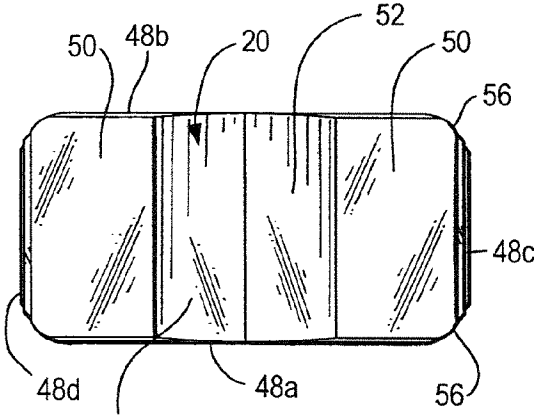
FIG. 1E is a bottom plan view thereof.
Figure 1G:
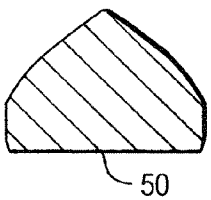
FIG. 1G is a cross sectional view of the invention taken along line G-G of FIG. 1B.
Figure 1D:
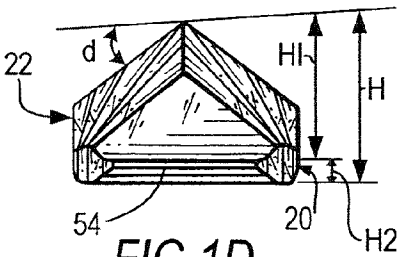
FIG. 1D is a side view thereof.
Figure 1F:
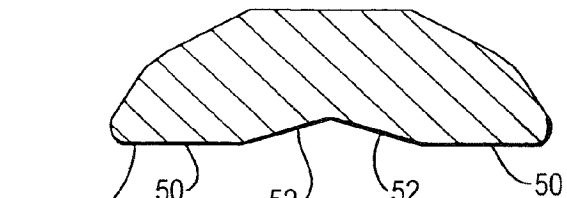
FIG. 1F is a cross sectional view of the invention taken along line F-F of FIG. 1B.

Referring particularly to FIG. 1A-FIG. 1G, a gemstone according to the present invention is generally designated 10. Gemstone 10, which has a front 12, a back 14, a top 16 and a bottom 18, also includes a lower pavilion 20 and an upper crown 22. Advantageously, gemstone 10 does not include a table nor does it include a girdle.

Upper crown 22 has a front 24, a rear 26, a right side 28, a left side 30 and corners 32. The upper crown also defines a crown top surface 34 and a pair of longitudinally opposed multifaceted sides 36 that slope downwardly away from top surface 34 and towards pavilion 20. Crown top surface 34 has two laterally opposed top surface portions 38. Each top surface portion 38 has a central facet 40. Advantageously, central facet 40 is in the form of a triangle having sides 40*a*, 40*b* and 40*c*. Central facets 40 meet at sides 40*c* to form a straight generally horizontal linear peak 42 that runs in a longitudinal direction between multifaceted sides 36. One of surface portions 38 slopes downwardly in a lateral direction away from peak 42 towards front 24 of crown 22. The other of said surface portions 38 slopes downwardly in a lateral direction away from peak 42 towards rear 26 of the crown. Each top surface portion 38 also includes a pair of opposed side facets 44. Advantageously, side facets 44 are in the form of a trapezoid or a truncated triangle having sides 44*a*, 44*b*, 44*c* and 44*d*, with sides 44*c* and 44*d* parallel to each other. Side 40*b* of central facet 40 is common to one of the sides of side facet 44 and side 40*a* of central facet 40 is common to one of the sides of the other of side facet 44.

Longitudinally opposed multifaceted sides 36 include facets 46 in the form of narrow triangular top facets 46*a*, larger triangular side facets 46*b* and triangular front and rear facets 46*c*. When viewed from the front, facets 46 are stepped forming crown angles a, b and c. When viewed from the side, facets 46 form crown angle d.

Pavilion 20, which has a front 48*a*, a rear 48*b* and sides 48*c* and 48*d*, has a bottom surface 49 which is formed by a pair of longitudinally opposed horizontally directed planar bottom portions 50 and inwardly directed planar bottom portions 52 which are disposed between bottom portions 50. Bottom portions 52 are longitudinally slanted upwardly towards one another. Together bottom portions 52 form a pavilion angle e. Pavilion 20 may also include narrow rectangular facets 54 which are located along front 48*a*, rear 48*b* and sides 48*c*, 48*d* of the pavilion. Pavilion 20 also includes rounded corners 56. Corners 56 of pavilion 20 and corners 32 of crown 22 define gemstone corners 58 which may be formed with facets 60.

Gemstone 10 has a width W, a length L and a height H. Height H is formed of crown height H1 and pavilion height H2. Advantageously, height H is in the range of 30% to 70% of length L, while crown height H1 is in the range of 20% to 60% of length L. Likewise, advantageously crown angle a is in the range of 10° to 40°, crown angle b is in the range of 15° to 50°, crown angle c is in the range of 20° to 70°, crown angle d is in the range of 30° to 70° and pavilion angle e is in the range 100° to 160°.

Figure 2A:
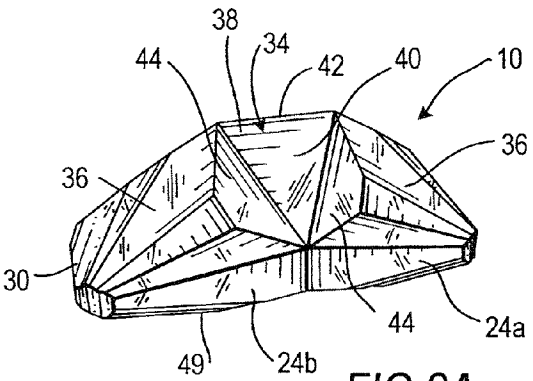
FIG. 2A is perspective view of a gemstone according to a second embodiment of the present invention.
Figure 2D:
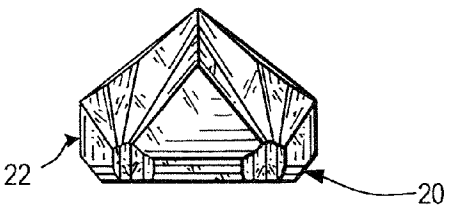
FIG. 2D is a side view thereof.
Figure 2B:
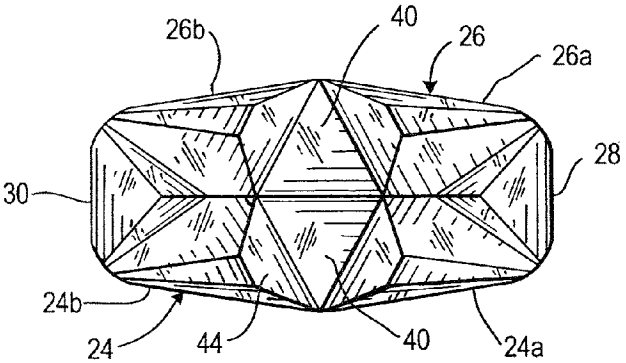
FIG. 2B is a top plan view thereof.
Figure 2C:
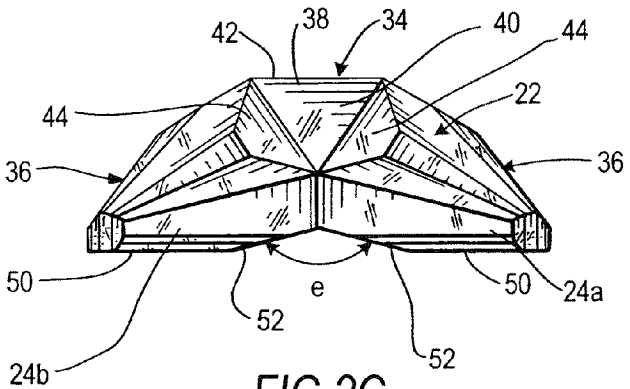
FIG. 2C is a front elevation view thereof.
Figure 3A:
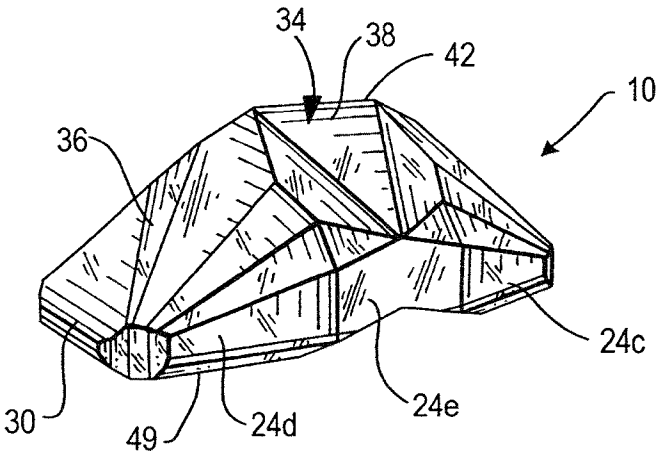
FIG. 3A is perspective view of a gemstone according to a third embodiment of the present invention.
Figure 3D:
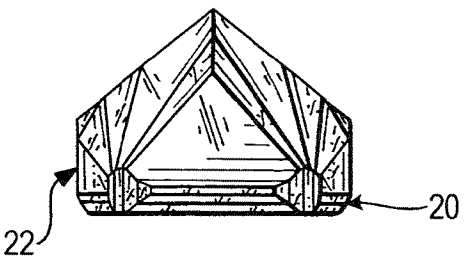
FIG. 3D is a side view thereof.
Figure 3B:
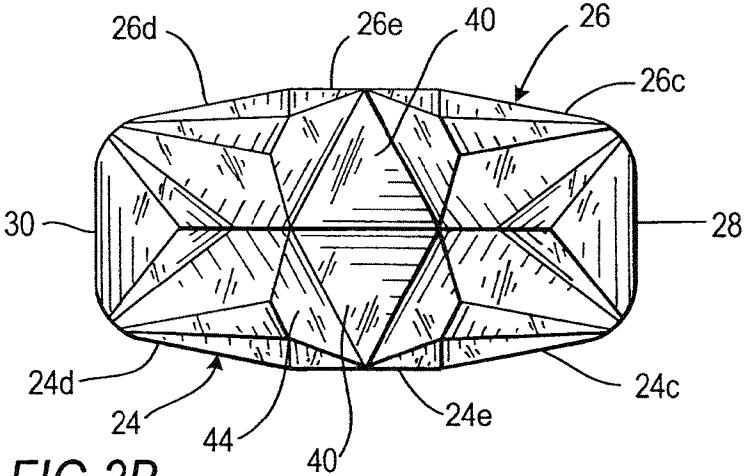
FIG. 3B is a top plan view thereof.
Figure 3C:
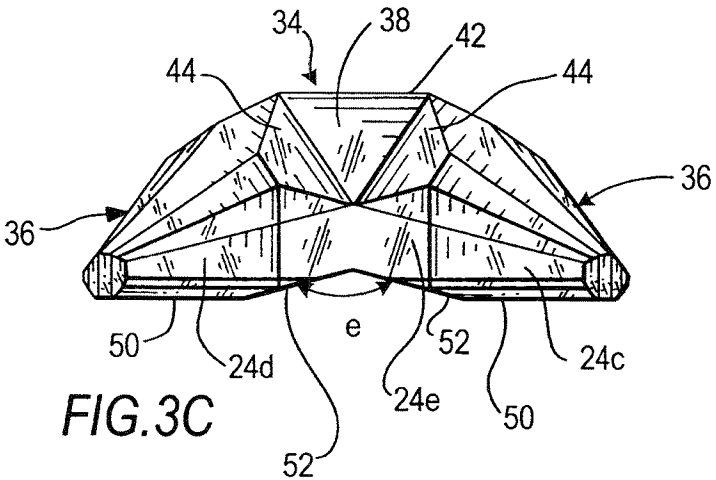
FIG. 3C is a front elevation view thereof.
Figure 4A:
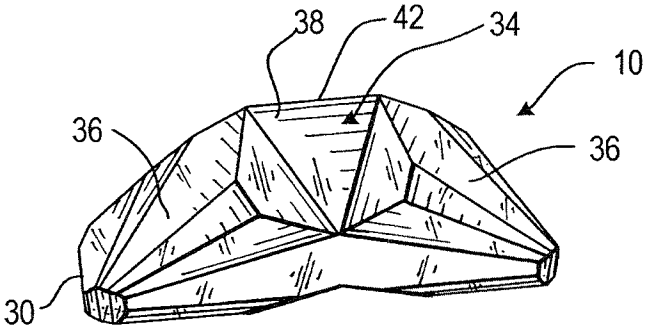
FIG. 4A is perspective view of a gemstone according to a fourth embodiment of the present invention.
Figure 4D:
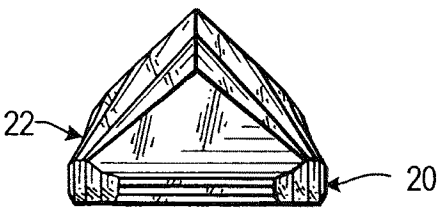
FIG. 4D is a side view thereof.
Figure 4B:
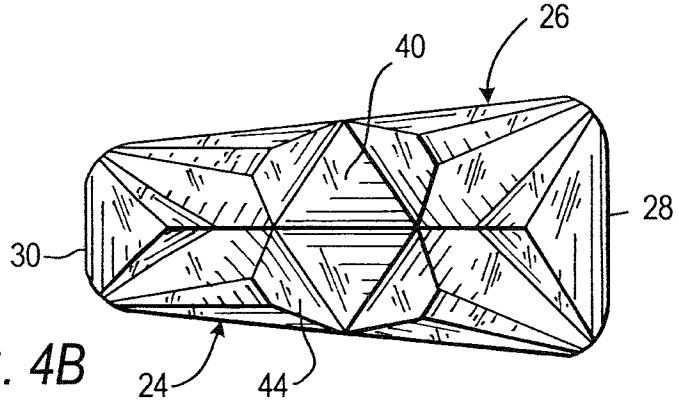
FIG. 4B is a top plan view thereof.
Figure 4C:
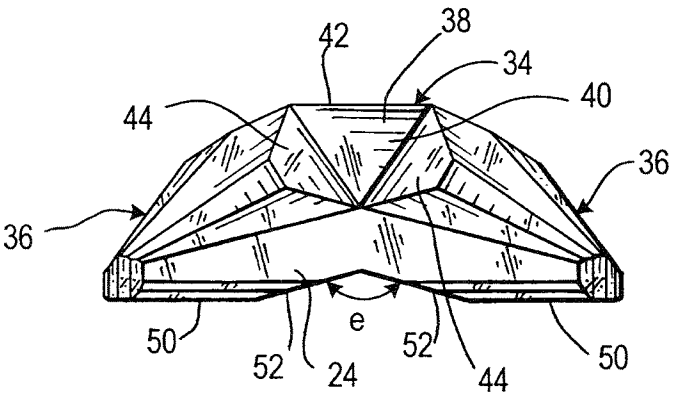
FIG. 4C is a front elevation view thereof.
Figure 5A:
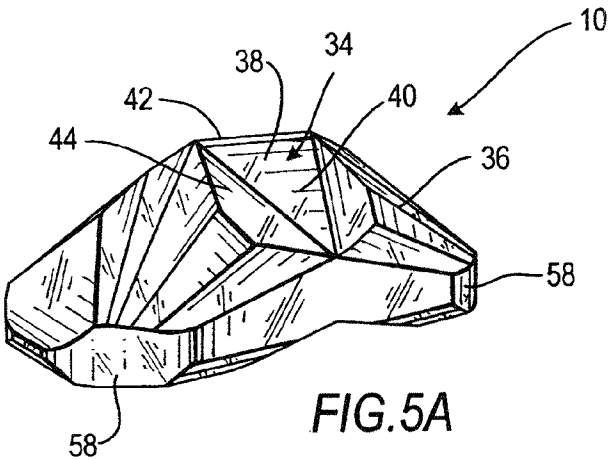
FIG. 5A is perspective view of a gemstone according to a fifth embodiment of the present invention.
Figure 5D:
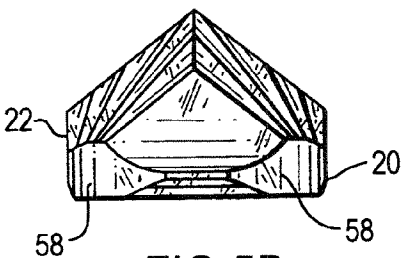
FIG. 5D is a side view thereof.
Figure 5B:
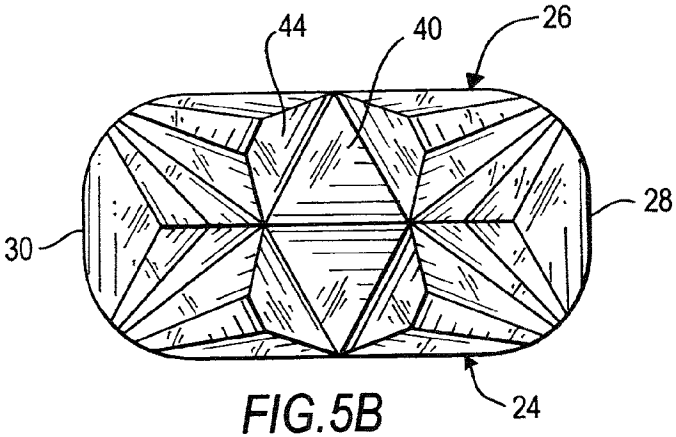
FIG. 5B is a top plan view thereof.
Figure 5C:
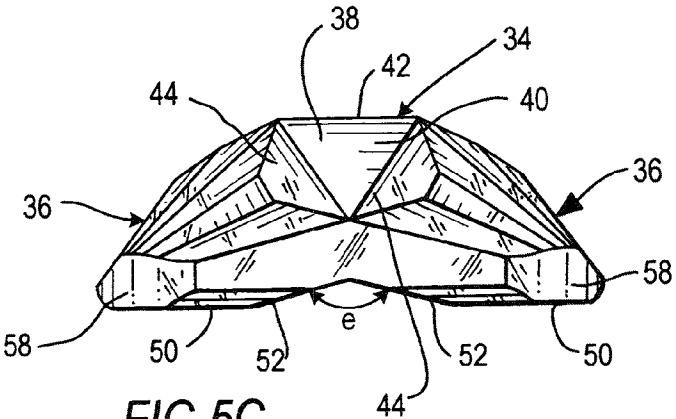
FIG. 5C is a front elevation view thereof.
Figure 6A:
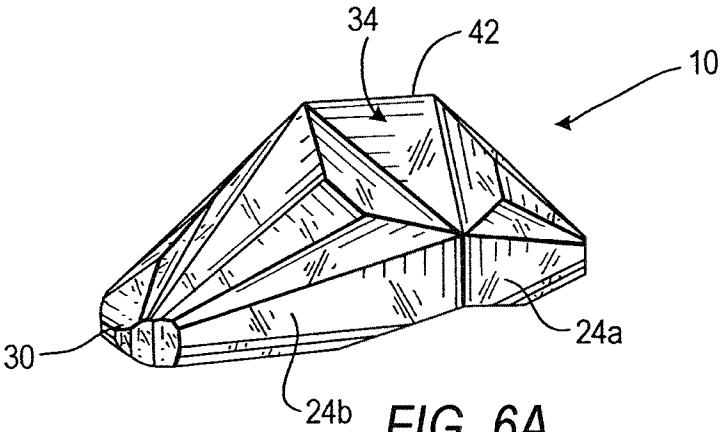
FIG. 6A is perspective view of a gemstone according to a sixth embodiment of the present invention.
Figure 6D:
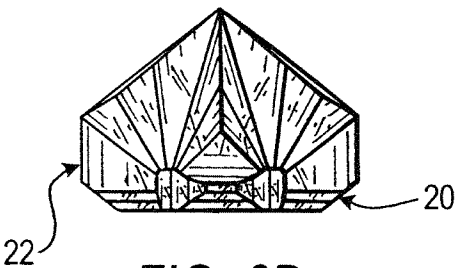
FIG. 6D is a side view thereof.
Figure 6B:
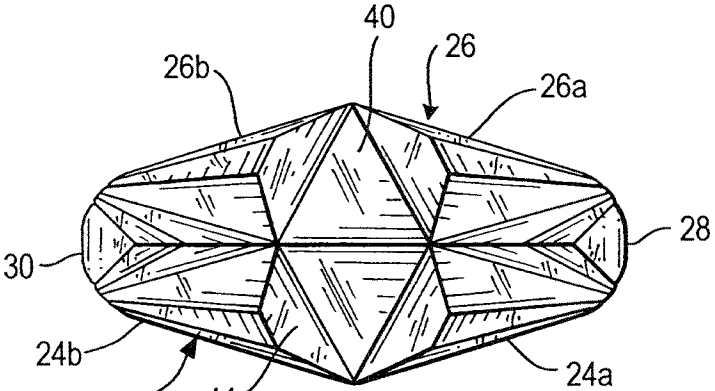
FIG. 6B is a top plan view thereof.
Figure 6C:
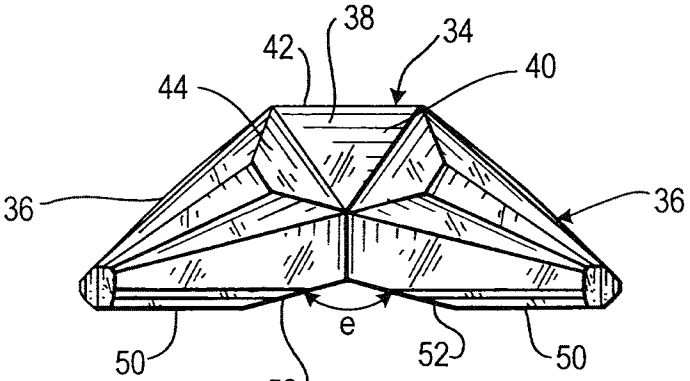
FIG. 6C is a front elevation view thereof.
Figure 7A:
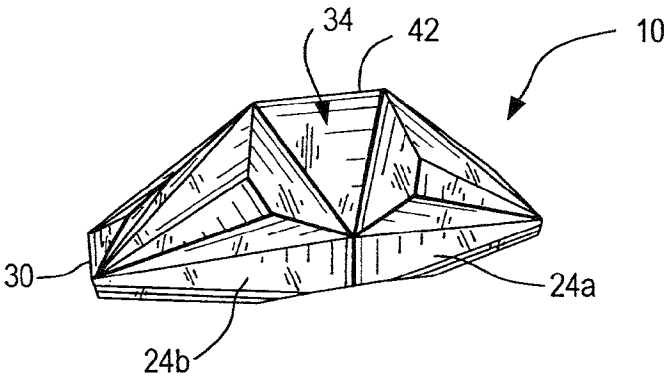
FIG. 7A is perspective view of a gemstone according to a seventh embodiment of the present invention.
Figure 7D:
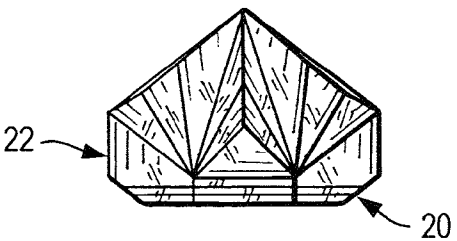
FIG. 7D is a side view thereof.
Figure 7B:
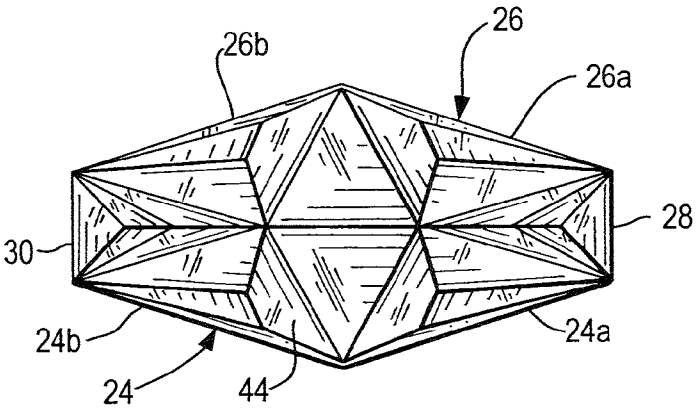
FIG. 7B is a top plan view thereof.
Figure 7C:
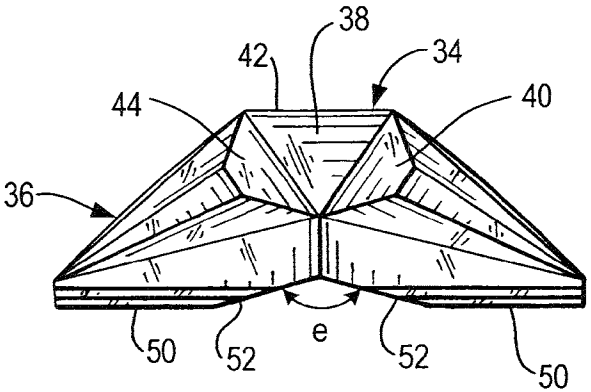
FIG. 7C is a front elevation view thereof.

FIG. 2A-FIG. 2D illustrate another embodiment of the invention. Like the first embodiment, gemstone 10 has a lower pavilion 20 and an upper crown 22 (the same reference numerals will be used herein for similar or corresponding parts). Thus, it also has a crown surface 34 having laterally opposed surface portions 38 and longitudinally opposed multifaceted sides 36, and opposed surface portions 38 including central facets 40 and side facets 44 which define a lateral and generally horizontal peak 42. As in the previous embodiment, opposed surface portions 38 slope downwardly from peak 42, with one of the surface portions sloping towards the rear 26 of crown 22 and the other surface portion sloping towards the front 24 of the crown. As previously described, the gemstone includes a bottom surface 49 of pavilion 20 having longitudinally opposed horizontally directed planar bottom portions 50 and inwardly directed planar bottom portions 52 which are longitudinally slanted upwardly towards one another to form a pavilion angle e. However, rather than being substantially straight and parallel one to the other as in the embodiment of FIG. 1A-FIG. 1G, the front 24 and the rear 26 of the crown are tapered. Specifically and as shown in FIG. 2*b*, front portion 24*a* tapers laterally towards rear portion 26*a* and rear portion 26*a* tapers laterally towards front portion 24*a*. Likewise, front portion 24*b* tapers laterally towards rear portion 26*b* and rear portion 26*b* tapers laterally towards front portion 24*b*.

In the embodiment of FIG. 3A-FIG. 3D, the front 24 and the back 26 of the crown are each divided into three portions. Two of the three portions, namely front portion 24*c* and rear portion 26*c* taper one to the other in a lateral direction and front portion 24*d* and rear portion 26*d* also taper one to the other in a lateral direction. However the third portions, namely front portion 24*e* and rear portion 26*e*, are substantially parallel to each other.

FIG. 4A-FIG. 4D shows an embodiment in which both front side 24 and rear side 26 of crown 22 are straight and substantially parallel, but where crown side 28 is greater than crown side 30.

In FIG. 5A-FIG. 5D, front side 24 and rear side 26 of crown 22 are straight and substantially parallel, but where crown sides 28 and 30 are substantially curved. Because of this curvature, gemstone corners 58 are larger than the gemstone corners 58 in the prior embodiments.

In the embodiment of FIG. 6A-FIG. 6D, front portion 24*a* and rear portion 26*a* taper laterally toward each other and front portion 24*b* and rear portion 26*b* taper laterally toward each other. However in this embodiment, the taper is greater than the taper in the embodiment of FIG. 2A-FIG. 2B and crown sides 28 and 30 are each substantially curved and smaller than the corresponding sides in the embodiment of FIG. 5A-FIG. 5B.

The embodiment of FIG. 7A-FIG. 7D is similar to the embodiment of FIG. 6A-FIG. 6D. However and in contrast to that embodiment, rather than being curved, crown sides 28 and 30 are now straight and parallel to each other.

It will be appreciated that gemstone 10 has a cut which provides radiance and brilliance. This is achieved by crown top surface 34 and longitudinally opposed multifaceted sides 36 on crown 22 and/or by the inwardly directed bottom portions 52 on pavilion 20.

FIG. 8-FIG. 15 illustrate how gemstones 10 may be assembled with links to form a jewelry element or assembly 62 that may be used in a piece of jewelry.

Figure 8:
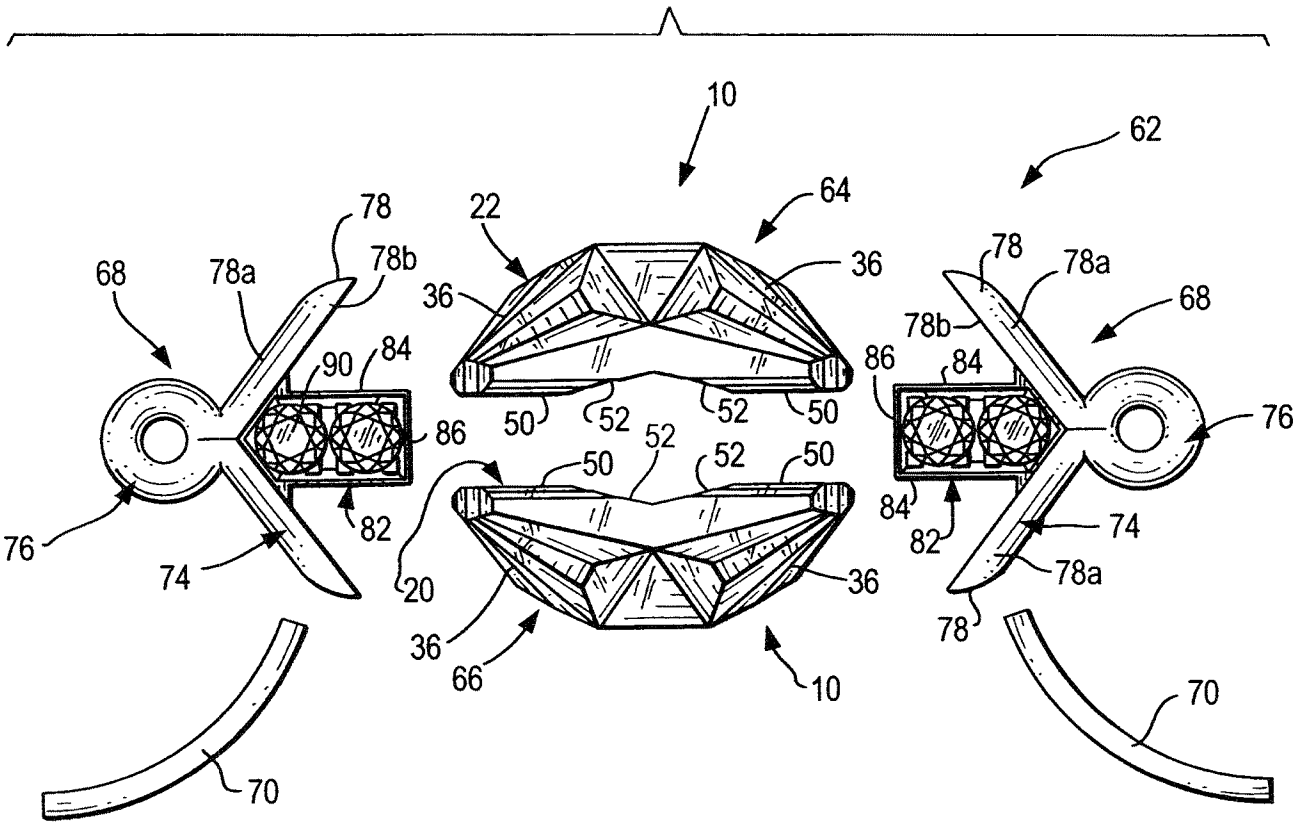
FIG. 8 is an exploded view showing two gemstones according to the present invention along with two links and attaching wires for use therewith used to form a jewelry assembly.
Figure 9:
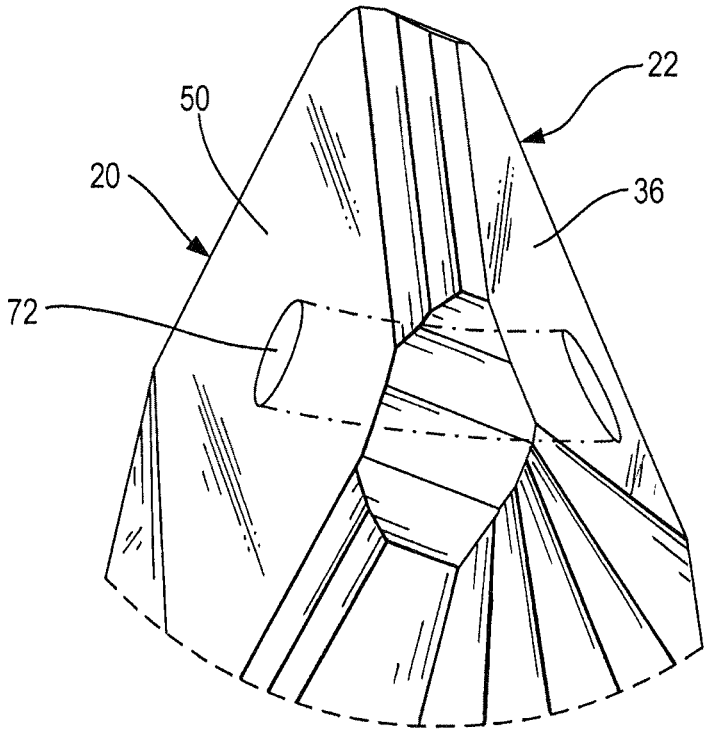
FIG. 9 is an enlarged partially perspective view showing further details of one of the gemstones shown in FIG. 8.

FIG. 8 shows the components of jewelry assembly 62. Assembly 62 includes two gemstones previously described. Thus, first gemstone 64 and second gemstone 66 each have a pavilion 20 and a crown 22. As previously described, each crown includes longitudinally opposed multifaceted sides 36. Also as previously described, pavilion 20 includes horizontal planar bottom portions 50 and inwardly directed bottom portions 52, which latter portions form a v-shaped configuration. Assembly 62 also includes links 68 and fastening members which may take the form of wire 70. As will be explained, wire 70 extends through a passageway 72 (see FIG. 9) formed in each gemstone which extends from bottom portion 50 of pavilion 20 to a multifaceted side 36 of crown 22. Although only one passageway 72 is shown in FIG. 9, each gemstone has two passageways, one passageway being near one end of the gemstone and the other passageway being near the other end of the gemstone.

Figure 10:
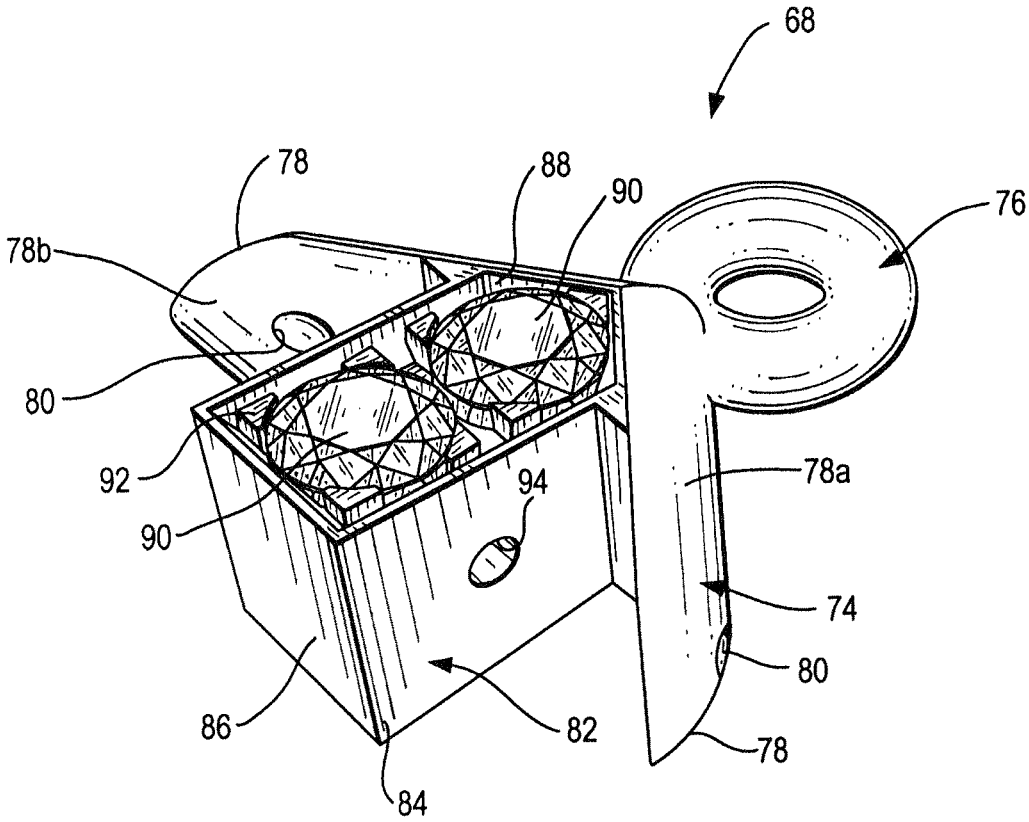
FIG. 10 is an enlarged perspective view showing further details of one of the links shown in FIG. 8.
Figure 13:
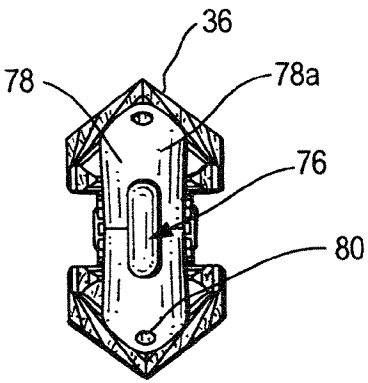
FIG. 13 is a side elevation view of the assembled gemstone and link of FIG. 11.
Figure 12:
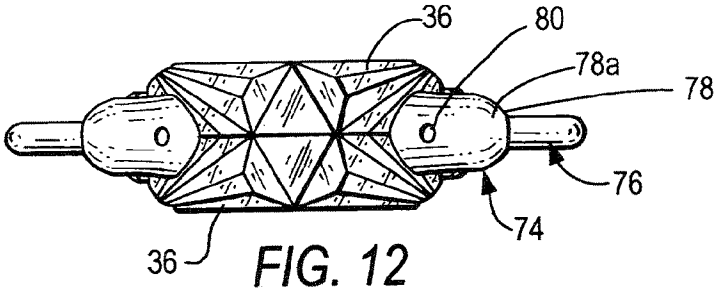
FIG. 12 is a top plan view of the assembled gemstone and link of FIG. 11.
Figure 11:
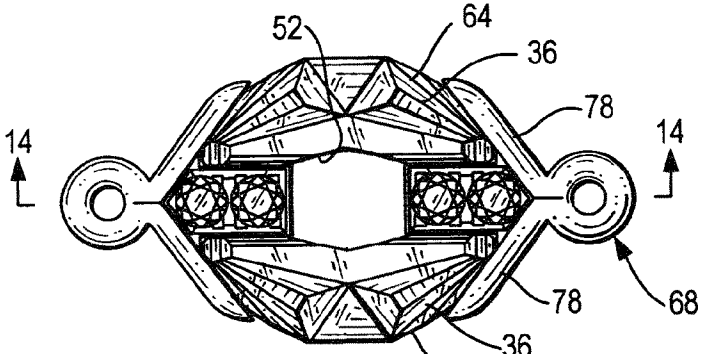
FIG. 11 is a front elevation view of the assembled gemstone and link of the present invention.
Figure 14:
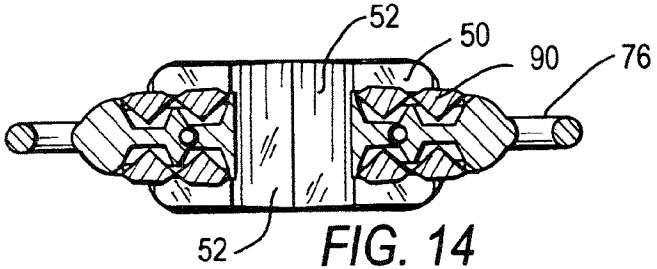
FIG. 14 is a cross sectional view of the assembled link and gemstone of taken along the line 14-14 of FIG. 11.

As shown in FIG. 10, link 68 includes a leaf member 74 and an eye 76, the latter used to connect the link of one assembly to the link of another assembly. Leaf member 74 includes angularly directed leaf arms 78 which form a generally v-shaped configuration. Each leaf arm 78 is angled to correspond to crown angle c (see FIG. 1C). Leaf arms 78 include an aperture 80 which runs from the top surface 78*a* of the leaf arm to bottom surface 78*b* of the leaf arm.

Link 68 also includes a spacer 82 which functions to separate first gemstone 64 from second gemstone 66 in an opposed spaced relationship when the gemstones are connected to the link. Spacer 82 is generally rectangular in configuration having opposed parallel planar side walls 84 and a planar end wall 86 located between the side walls at one end of the spacer. The spacer also includes a v-shaped end wall 88 at the other end of the spacer which is complementary with the v-shaped configuration of leaf arms 78. Spacer 82 may include decorative gemstones 90 mounted in fittings 92 located at the top and at the bottom of the spacer. A passageway 94 which runs through the spacer at side walls 84 is also provided.

FIG. 11-FIG. 14 show the various components of assembly 62 assembled together. As shown therein, links 68 receive first gemstone 64 and second gemstone 66, with leaf arms 78 configured to abut at least a portion of the multifaceted sides 36 of each gemstone at leaf arm surface 78*b*. This abutting configuration is due to the fact that each leaf arm 78 is angled to conform to crown angle c of the gemstone. Spacer 82 of each link 68 separates the first and second gemstones one from the other in an opposed spaced relationship. Specifically, spacer planar side wall 84 abuts first gemstone 64 at bottom portion 50 of the pavilion of that gemstone and the other spacer planar side wall 84 abuts the second gemstone 66 at the bottom portion 50 of that gemstone's pavilion. In this regard, it should be noticed that the spacer planar side walls 84 do not extend past bottom portions 50 of the pavilions and thus do not extend to the inwardly directed bottom portions 52 located at the bottom of the pavilions. In other words, the spacer does not extend longitudinally into the v-shaped configuration formed at the bottom of each pavilion. Not only does this provide a "clean" appearance in the form of a hexagonal shape when viewed from the side (see FIG. 11), but this also enables the v-shaped configuration at the bottom of each pavilion to enhance the brilliance or radiance of the assembly. It also will be appreciated that link 68 is formed of reduced metal as compared to conventional links previously used. This provides an aesthetically pleasing appearance for assembly 62.

In order to fasten gemstones 64 and 66 to link 68, wire 70 is inserted through aperture 80 in leaf arm 78, through passageway 72 in first gemstone 64, through passageway 94 in spacer 82, through passageway 72 in second gemstone 66 and through passageway 80 in the other leaf arm 78 of the link. Advantageously, wire 70 may be soldered or otherwise connected to each leaf arm 78 and then finished so as not to detract from the appearance of assembly 62. For purposes of clarity, wire 70 is not shown in FIG. 11-FIG. 14.

Figure 15:
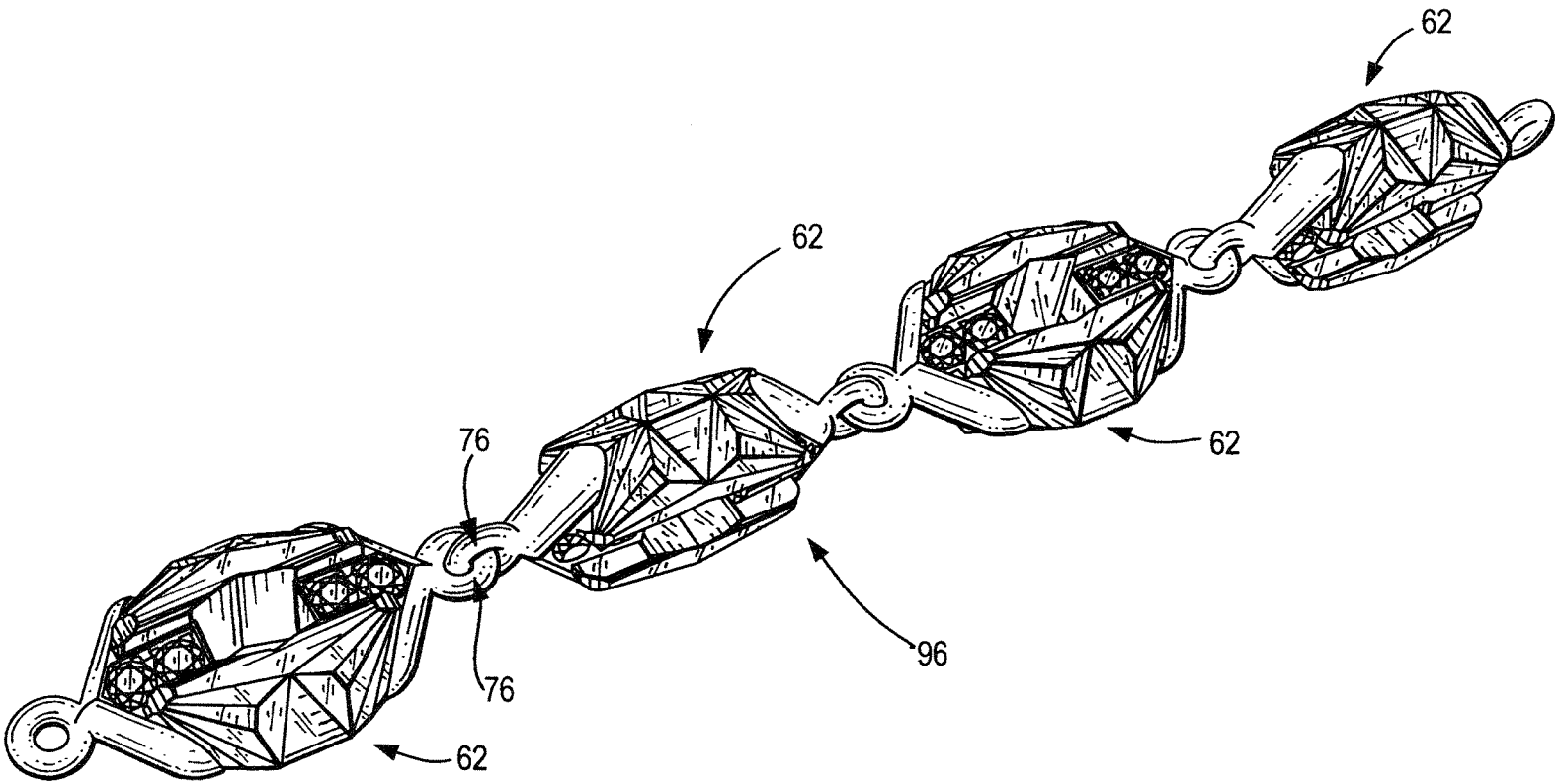
FIG. 15 shows a plurality of assembled gemstones and links of the present invention joined together to form part of a piece of jewelry.

FIG. 15 shows an assembly 62 connected to other assemblies 62 at eyes 76 to form a piece of jewelry 96. It will be appreciated that in jewelry piece 96, assemblies 62 provide a look which emphasizes the gemstones while minimizing the metal of the link. Thus, the overall look of jewelry piece 96 is one of gemstones, rather than metal.

Thus, the present invention provides a multifaceted gemstone and link assembly for an article of jewelry which decreases the amount of metal required for the link. The gemstone is also securely attached to the link preventing loss of the stone.

The gemstones may be varied by changing the rear, front and sides of the crown, while still retaining a common cut which provides radiance and brilliance of the stone. The cut is also configured so that the gemstone can be placed within the link.

While the present invention has been described with reference to several preferred embodiments, the invention should not be so limited. For example, while the multifaceted gemstones 64 and 66 are preferably secured to link 68 by wire 70 which runs through passageways in the gemstones and the link, the gemstones might secured to the link in other ways. For example, the gemstones might be glued to the link by applying glue to spacer sidewalls 84 and/or to leaf arm surfaces 78*b*. As another example, the bottom of pavilion 20 may be completely flat with inwardly directed bottom portions 52 eliminated or, if desired, inwardly directed bottom portions 52 may be "stepped" wherein the individual surfaces 52 are formed of a plurality of planar surfaces.

The scope of the invention will now be set forth in the following claims:

1. An article of jewelry comprising:

first and second gemstones, each having a lower pavilion and an upper crown, said crown having a multifaceted surface and said pavilion having a bottom surface, each gemstone having a first and a second end; and first and second links, each said link further having a leaf member defined by first and second angularly directed leaf arms forming a v-configuration, each leaf arm engaging one of said ends to hold said gemstones with said bottom surfaces in parallel to each other;

each said link further including a spacer attached between said leaf arms and disposed between said bottom surfaces to define a predetermined space therebetween; and wherein each of said gemstones includes a passageway extending between said multifaceted side of said crown and said bottom surface of said pavilion, said jewelry element further having a fastening member extending through said passageways for fastening said gemstones to said link.

2. The article of jewelry of claim 1 further comprising additional gems disposed on said spacers.

3. The article of jewelry of claim 1, wherein each said spacer has a first end with a configuration complementary with said v-configuration of said arms.

4. The jewelry article according to claim 1, wherein said fastening element connects said first gemstone to said first leaf arm and connects said second gemstone to said second leaf arm.

5. The jewelry article according to claim 4, wherein said connecting member extends through a passageway in said spacer.

6. The jewelry article according to claim 1, wherein said bottom surface of said pavilion includes a pair of longitudinally disposed planar bottom portions separated by a pair of intermediate bottom portions that are longitudinally slanted towards one another, said intermediate portions together forming an inverted v-shaped configuration.

7. The jewelry article according to claim 6, wherein said spacers do not extend to said intermediate bottom portions of said pavilion.

8. The article of jewelry of claim 1, wherein said bottom surface of said pavilion of each of said gemstones includes at least one planar bottom portion and said spacers include opposed planar sides, each planar side abutting a respective planar bottom portion.

9. The jewelry article according to claim 8, wherein said bottom surface of each said pavilion includes at least one at least one horizontally disposed bottom portion and at least one bottom portion slanted upwardly towards said crown.

10. The jewelry article according to claim 9, wherein said spacer does not extend past said horizontally disposed bottom portion of said gemstones.

11. A jewelry article comprising:

a plurality of gemstones arranged in pairs of first and second gemstones, each having a lower pavilion and an upper crown, said crown having a multifaceted surface and said pavilion having a bottom surface, each gemstone having a first and a second end; and a plurality of links, each said link engaging a respective end of each of said pairs of gemstones to form a chain with said gemstones having said bottom surfaces in parallel to each other;

each said link further including a spacer extending between said bottom surfaces to define a predetermined space therebetween said pairs of gemstones; and wherein each of said gemstones includes a passageway extending between said multifaceted side of said crown and said bottom surface of said pavilion, said jewelry element further having a fastening member extending through said passageways for fastening said gemstones to said link.

12. The jewelry article of claim 11 further comprising additional gems attached to said spacers.

* * * * *